United States Patent [19]

Schönberger et al.

[11] Patent Number: 4,509,562

[45] Date of Patent: Apr. 9, 1985

[54] CIRCULAR LOOM

[75] Inventors: Johann Schönberger, Timelkam; Johann Bloo, Rosenau; Bruno Mistlberger, Vöcklabruck; Johann Gehmaier, Gampern, all of Austria

[73] Assignee: Chemiefaser Lenzing Aktiengesellschaft

[21] Appl. No.: 550,943

[22] Filed: Nov. 14, 1983

[30] Foreign Application Priority Data

Nov. 11, 1982 [AT] Austria ..... 4100/82

[51] Int. Cl.[3] ..... D03D 37/00

[52] U.S. Cl. ..... 139/13 R

[58] Field of Search ..... 139/13 R, 13 A, 15, 139/16, 436

[56] References Cited

U.S. PATENT DOCUMENTS 2,813,547 11/1957 Rabeux et al. ..... 139/13 R 3,076,482 2/1963 Christiansen et al. ..... 139/13 A 3,871,413 3/1975 Torii ..... 139/13 R

*Primary Examiner*—Henry S. Jaudon

*Attorney, Agent, or Firm*—Brumbaugh, Graves, Donohue & Raymond

[57] ABSTRACT

A circular loom comprises a machine frame including an upper and a lower running race. Between the running races, a reed and at least one shuttle are arranged. The shuttle is guided in the running races by running rollers arranged on its front and rear ends and is drivable by a catch roller arranged on a rotor. In order to provide an improved shuttle drive that is less susceptible to failures and with which the shuttle will not be pressed out of the running races, the catch roller is in contact with a running roller arranged on the front end of the shuttle during operation and is provided between the running rollers arranged on the front and rear ends of the shuttle.

2 Claims, 4 Drawing Figures

CIRCULAR LOOM

BACKGROUND OF THE INVENTION

The invention relates to a circular loom comprising a machine frame including an upper and a lower running race, between which a reed and at least one shuttle are arranged, the shuttle being guided in the running races by means of running rollers arranged on its front and rear ends, and being drivable by means of a catch roller arranged on a rotor.

A circular loom of this type is known from German Pat. No. 24 62 121. The catch roller of that circular loom, which is rotatably journaled on the rotor, contacts the rear running roller—in the moving direction of the shuttle—directly rolling on a lower running race, the shuttle thus being pushed along the running races. By this type of drive, the shuttle is pressed out of the guiding rails, in particular when starting the machine, which may lead to failures and, as a further consequence, to interruptions in the production process and to production losses.

The invention aims at avoiding these disadvantages and difficulties and has as its object to provide a circular loom with an improved shuttle drive that is less susceptible to failures and with which the shuttle will not be pressed out of the running races.

SUMMARY OF THE INVENTION

This object is achieved according to the invention in that the catch roller, in a manner known per se, is in contact with a running roller arranged on the front end of the shuttle, during operation, the catch roller being provided between the running rollers arranged on the front and rear ends of the shuttle. By this "front wheel" driving method, the shuttle is pulled along the running races, whereby it is not pressed out of the running races, thus running more smoothly, in particular when starting the machine.

From Swiss Pat. No. 277,617 a circular loom is known, comprising a shuttle that is provided with a roller on its front end, which roller, during operation, is in contact with a catch roller moving in the track of the shuttle. However, this roller merely serves to drive the shuttle and not to support the same so that the known circular loom is not suited for high weaving performances due to the friction occurring between the shuttle and the warp threads. Difficulties are to be expected, in particular, when starting this known machine.

According to a preferred embodiment of the present invention, the running roller that is in contact with the catch roller comprises a frustoconical projection extending from the running race in the direction towards its center and tapering in this direction, with which the catch roller (which also has a frustoconical jacket part contacting the running roller of the shuttle) contacts. By this design, it is possible to considerably increase the service lives of the running rollers and of the catch roller.

BRIEF DESCRIPTION OF THE DRAWINGS

The invention will now be explained in more detail by way of one embodiment and with reference to the accompanying drawings, wherein.

DESCRIPTION OF EXEMPLARY EMBODIMENT

Figure 1:
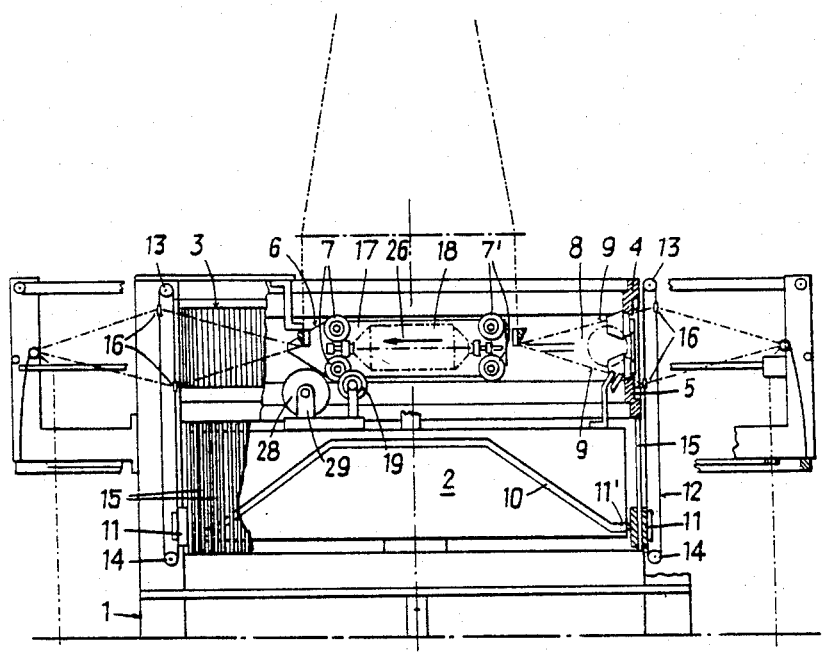
FIG. 1 is a partially sectioned overall view of a machine constructed in accordance with the present invention.
Figure 3:
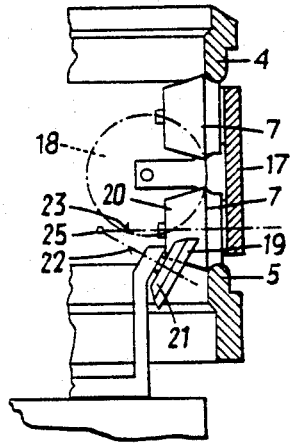
FIG. 3 illustrates a section taken along the line III—III of FIG. 2.
Figure 2:
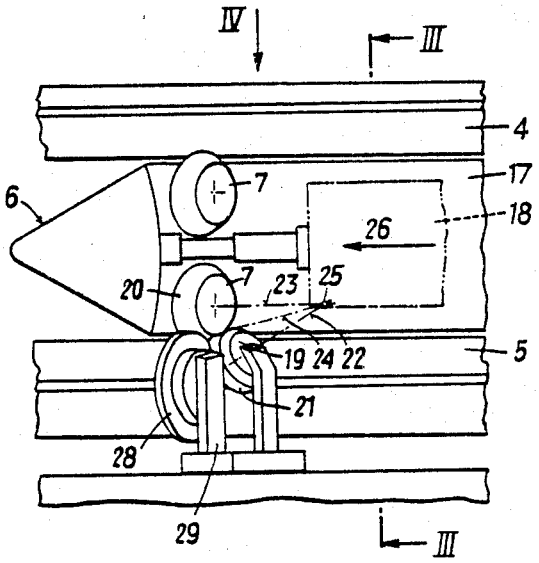
FIG. 2 illustrates a part of the machine of FIG. 1 on an enlarged scale.
Figure 4:
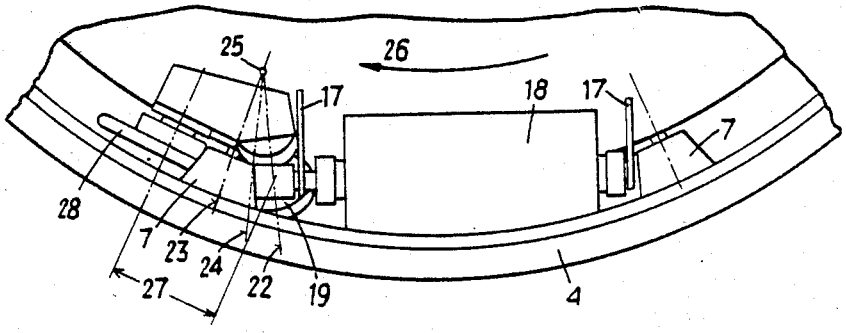
FIG. 4 illustrates a view taken in the direction of the arrow IV of FIG. 2.

The circular loom comprises a machine frame 1, in which a drivable rotor 2 is rotatably mounted, arranged below a stationary reed 3. The reed is delimited by an upper and a lower running race 4, 5, along which running races at least one shuttle 6 is guided by means of running rollers 7, 7'.

To form a shed 8 by the warp threads 9, a harness is arranged in a circle concentric to the rotor 2, which harness comprises a wavy groove 10 machined in the outer side of the rotor 2 and catch elements 11 engaging in the groove and designed as sliding blocks. In order to reduce to a minimum the friction occuring between the catch elements 11 and the rotor, the catch elements 11 may include rotatable rollers 11' inserted in the groove 10.

Each of the catch elements 11 carries a plurality of flexible bands 12 or cords, which are each guided over an upper 13 and a lower 14 deflection pulley rotatably journaled on the machine frame 1. For the purpose of an exact vertical guidance, each catch element 11 is guided along two parallelly and vertically arranged guiding rods 15 rigidly fastened to the machine frame 1 and penetrating the catch element 11.

To each band 12 spaced-apart thread guiding organs 16, for instance eyes, are fastened.

The shuttle 6 includes a supporting body 17 carrying the weft thread bobbin 18. The running rollers 7, 7' are guided on the upper and lower running races 4, 5 of the reed 3, each having a semi-circular-arc section. The counter sections of the running rollers are designed so as to adapt to the, preferably, semi-circular-arc shaped sections of the running races 4, 5, and to be approximately quarter-circular-arc shaped, extending beyond the vertex of the running race section, so that the running rollers 7 will transmit to the running races 4, 5 both the centrifugal force and supporting forces, a tilting out of the shuttle 6 when out of operation being avoided. There are also possible other design types for the sections of the running races and for the counter sections of the running rollers of the shuttle, which serve the same purpose, e.g., polyangular or elliptic shapes.

Driving of the shuttle 6 is effected by means of a catch roller 19 freely rotatably fastened to the rotor 2. The catch roller 19 is arranged between the running rollers 7, 7' disposed on the front and on the rear ends of the shuttle 6 and, during operation, i.e., with the shuttle 6 circulating, contacts a running roller 7 arranged on the front end of the shuttle 6 and rolling on the lower running race 5. By this measure, the shuttle 6 is sort of pulled along the running races 4, 5 by means of a front wheel drive, its smooth running thus being considerably improved.

The running roller 7 that contacts the catch roller 19 includes a frustoconical projection 20 extending from the running race 5 in the direction to its center and tapering in this direction, with which projection the catch roller 19 gets into contact by a likewisely frustoconical jacket part 21 provided on it. The rotation axis 22 of the catch roller 19 intersects with the axis 23 of the running roller and with the extension of the line of contact 24 of the catch roller 19 with the running roller 7 in a point 25, whereby the service lives of the catch roller 19 as well as of the running roller 7 getting into contact therewith are increased.

In order to prevent the shuttle 6 from running on in case the machine has been stopped, a further freely rotatable roller 28 is mounted to the rotor, i.e. to a supporting body 29 fastened to the rotor, in the moving direction 26 in front of the catch roller 19 at a distance 27, which distance 27 is dimensioned such that the running roller 7 of the shuttle 6 lying therebetween comprises a play at least relative to one of the rollers 19 and 28.

What we claim is:

1. In a circular loom of the type including a machine frame including an upper running race and a lower running race, a reed and at least one shuttle having a front end and a rear end arranged between said upper running race and said lower running race, running roller means arranged on said shuttle front end and on said shuttle rear end, a rotor, and a catch roller arranged on said rotor to drive said shuttle, the improvement which is characterized in that said running roller means are adapted to support and guide said shuttle between said upper and lower running races and include a running roller arranged on said shuttle front end, and wherein said catch roller, during operation, is in contact with said running roller arranged on said shuttle front end, said catch roller being provided between said running roller means arranged on said shuttle front end and on said shuttle rear end.

2. In a circular loom of the type including a machine frame including an upper running race and a lower running race, a reed and at least one shuttle having a front end and a rear end arranged between said upper running race and said lower running race, running roller means arranged on said shuttle front end and on said shuttle rear end, a rotor, and a catch roller arranged on said rotor to drive said shuttle, the improvement which is characterized in that said running roller means are adapted to support and guide said shuttle in said upper running race and said lower running race, and include a running roller arranged on said shuttle front end, said front end running roller comprising a frustoconical projection extending from a running race in a direction towards the center of said race and tapering in said direction, and wherein said catch roller, during operation, is in contact with said running roller arranged on said shuttle front end, said catch roller being provided between said running roller means arranged on said shuttle front end and on said shuttle rear end and including a frustoconical jacket part which contacts said frustoconical projection of said front end running roller.

* * * * *